United States Patent [19]

Parks

[11] Patent Number: 4,993,289

[45] Date of Patent: Feb. 19, 1991

[54] DRIVE ELEMENT WITH DRIVE BORE HAVING COMPOUND ENTRY SURFACE

[75] Inventor: James R. Parks, Franklin, Wis.

[73] Assignee: Snap-on Tools Corporation, Kenosha, Wis.

[21] Appl. No.: 566,862

[22] Filed: Aug. 13, 1990

Related U.S. Application Data

[63] Continuation of Ser. No. 428,928, Oct. 27, 1989, abandoned.

[51] Int. Cl.[5] ..... B25B 00/00

[52] U.S. Cl. ..... 81/124.6; 81/121.1

[58] Field of Search ..... 81/121.1, 124.6

[56] References Cited

U.S. PATENT DOCUMENTS 1,329,560 2/1920 Thomas .
2,634,642 4/1953 Viets ..... 81/124.6
2,777,353 1/1957 Willis .
3,250,157 5/1966 Badger .
3,273,430 9/1966 Knudsen et al. .
3,295,572 1/1967 Wing .
3,713,356 1/1973 Knudsen .
4,126,063 11/1978 Palmer ..... 81/124.6

*Primary Examiner*—James G. Smith
*Attorney, Agent, or Firm*—Emrich & Dithmar

[57] ABSTRACT

A drive element includes a drive bore having an entry end within which is formed a sloping entry surface. The entry surface extends from an outer surface of the drive element partially into the drive bore and has discrete portions respectively inclined with respect to a central axis of the drive bore at different slopes. The sloping entry surface may include a portion with a continuously varying slope. A driver is disclosed for use with the drive element.

20 Claims, 1 Drawing Sheet

DRIVE ELEMENT WITH DRIVE BORE HAVING COMPOUND ENTRY SURFACE

This is a continuation of application Ser. No. 428,928, filed Oct. 27, 1989 now abandoned.

BACKGROUND OF THE INVENTION

1. Field of the Invention

The present invention relates to a drive element for use with a driver. The invention relates in particular to a construction of an entry surface formed at the entry end of a drive bore formed in the drive element.

2. Description of the Prior Art

A drive element for use with a driver typically comprises a body within which is formed a drive bore including a central axis, and a plurality of intersecting flat side surfaces parallel to the central axis for mateably receiving a drive lug of a driver which includes a corresponding plurality of intersecting flat side surfaces and a resiliently retractable ball projecting from one of the side surfaces. In order to facilitate the depression of the ball as the drive lug is inserted into the drive bore, current drive elements comprise a frustoconical entry surface which is formed at an entry end of the drive bore.

The entry surface has been formed at a relatively large acute angle with respect to the central axis of the drive bore to minimize the axial distance which the entry surface extends into the drive bore. The large angle, however, is disadvantageous since it provides only a small lateral component of force against the ball in order to retract it, thereby requiring a large axial force to insert the drive lug in the drive bore.

If, alternatively, the entry surface is formed at a small angle with respect to the central axis of the drive bore to increase the lateral component of force which is applied against the ball in order to retract it, then the entry surface extends too far axially into the drive bore, thereby unduly decreasing the portion of the drive bore which is available for driving engagement with the drive lug.

SUMMARY OF THE INVENTION

It is a general object of the present invention to provide an improved drive element which avoids the disadvantages of prior drive elements, while affording additional structural and operating advantages.

An important feature of the present invention is the provision of a drive element having a drive bore with an entry surface such that the element can relatively easily be mounted on an associated driver without unduly decreasing the portion of the drive bore which is available for driving engagement with the drive lug.

In connection with the foregoing feature, another feature is the provision of an entry surface which is of varying slope in order to increase the lateral component of force which is applied against the ball to retract the same.

Another feature is the provision of a drive element, as set forth above, in combination with an associated driver.

These and other features of the invention are attained by providing a element for use with a driver comprising: a body including an outer surface, a drive bore formed in the body including an entry end at the outer surface and an inner end, the drive bore including a central axis and a plurality of intersecting flat side surfaces parallel to the axis, and a sloping entry surface formed at the entry end of the drive bore around the perimeter thereof, the entry surface extending from the outer surface partially into the drive bore and being inclined with respect to the axis at a varying slope.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
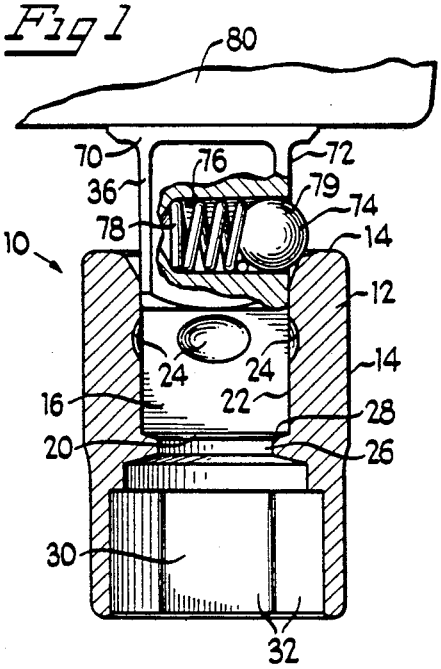
FIG. 1 is a fragmentary, vertical sectional view of a drive element/driver combination according to a first embodiment of the present invention, with the drive element shown being inserted onto the drive lug of the driver.

Referring to FIG. 1, there is illustrated therein a drive element, generally designated by the numeral 10, constructed in accordance with and embodying the features of the present invention. For the purposes of illustration, the drive element 10 is shown in the form of a fastener engaging element, viz., a socket for engaging a nut or a headed fastener, such as a screw or bolt. However, it will be appreciated that the drive element 10 may, alternatively, be a fastener engaging element constructed for engaging other types of fasteners, or may be a drive element for engaging extensions, adapters, universal joints and other types of driven members.

The drive element 10 comprises a body 12 including an outer surface 14. The drive element 10 further comprises a drive bore 16 formed in one end of the body 12. The drive bore 16 includes an entry end 18 (FIG. 3) at the outer surface 14, and an inner end 20. The drive bore 16 includes a central axis X (FIG. 3) and a plurality of intersecting side surfaces 22 which are parallel to the central axis X. In the present embodiment, the drive bore 16 includes four flat side surfaces 22 such that the drive bore 16 is substantially square in transverse cross section. Each of the side surfaces 22 has an arcuate recess 24 formed therein intermediate the entry end 18 and the inner end 20 of the drive bore 16.

The drive element 10 further comprises a cylindrical bore 26, formed in the body 12 at the inner end 20 of the drive bore 16 coaxially therewith. A shoulder 28 (FIG. 1) is formed in the body 12 intermediate the drive bore 16 and the cylindrical bore 26.

Still further, the drive element 10 comprises a socket 30 which is formed in the opposite end of the body 12 coaxially with the drive bore 16. The socket is provided with a plurality of intersecting flat interior surfaces 32 arranged to mateably receive a nut or the head of a screw or bolt to be tightened or loosened.

The drive bore 16 receives a correspondingly shaped but slightly smaller drive lug 70 of a driver 80. While the illustrated drive 80 is a ratchet driver, it will be appreciated that the present invention could be used with other types of drivers. The drive lug 70 includes a plurality of intersecting flat side surfaces 72 and a retractable ball 74 which is disposed in and projects from a bore 76 formed in one of the side surfaces 72. A helical compression spring 78 is seated in the bore 76 and resiliently urges the ball 74 outwardly beyond the associated side surface 72. The bore 76 has an inwardly tapered outer end 79 to limit the extent of projection of the ball 74. The drive element 10 is detachably associated with the drive lug 70 in a customary manner wherein the drive lug 70 is inserted into the drive bore 16 until the ball 74 is seated within the recess 24 in one of the side surfaces 22. Once the drive element 10 has been secured onto the drive lug 70, rotation may be imparted to the drive element 10 and a fastener received in the socket 30.

Figure 2:
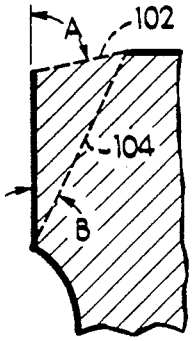
FIG. 2 is an enlarged, fragmentary, sectional view of a prior art drive element with alternate entry surfaces shown in broken lines.

In order to facilitate the depression of the ball 74 as the drive lug 70 is inserted into the drive bore 16, prior art drive elements have included a frustoconical entry surface. As shown in FIG. 2, a prior art drive element typically includes either an entry surface 102 inclined at a given slope and an angle A with respect to the central axis X of the drive bore, or an entry surface 104 inclined at a given slope and an angle B with respect to the central axis X of the drive bore.

The entry surface 102 is disadvantageous since it provides only a small lateral component of force against the ball in order to retract it, thereby requiring a large axial force to insert the drive lug in the drive bore. The entry surface 104 is disadvantageous since it extends too far axially into the bore, thereby unduly decreasing the portion of the bore which is available for driving engagement with the drive lug.

The drive element 10 of the present invention overcomes the above-identified disadvantages associated with the prior art.

Figure 3:
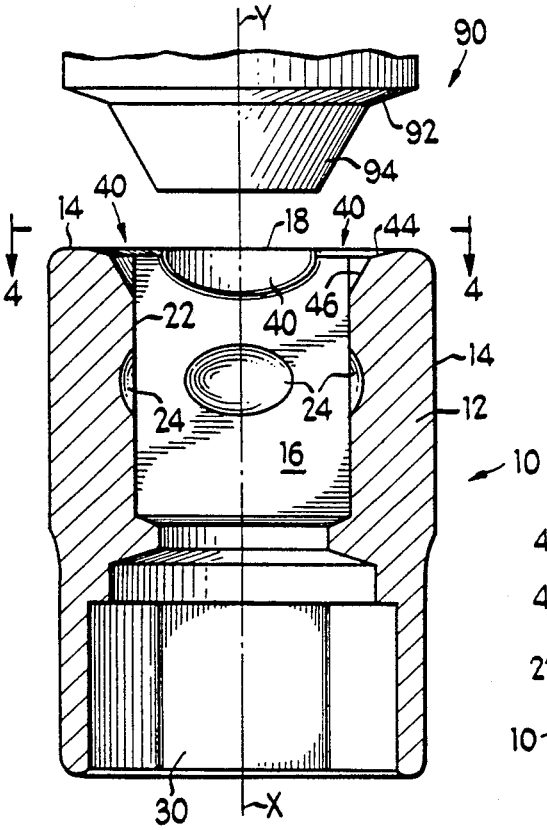
FIG. 3 is an enlarged view of the drive element of FIG. 1 in vertical section, and an associated frustoconical electrode, shown in fragmentary elevation, used to form the entry surface of the drive bore of the drive element.
Figure 4:
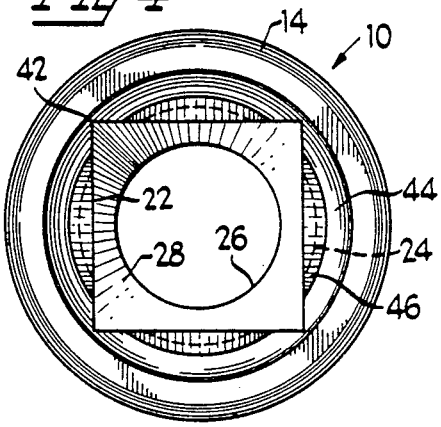
FIG. 4 is a plan view of the drive element of the present invention, taken along the line 4—4 of FIG. 3.

As shown in FIG. 3, the drive element 10 has an entry surface, generally designated by the numeral 40, formed at the entry end 18 of the drive bore 16. The entry surface 40 extends around the periphery of the drive bore 16. As shown in FIG. 4, the entry surface 40 does not extend continuously around the periphery of the entry end 18 of the drive bore 16 but, rather, is interrupted by corners 42 of the drive bore 16. The entry surface 40 extends from the outer surface 14 of the body 12 partially into the drive bore 16 and is inclined with respect to the central axis X thereof.

The entry surface 40 includes a first portion 44 extending convergingly inwardly from the entry end 18 of the drive bore 16, and a second portion 46 extending convergingly inwardly from the first portion 44.

As shown in FIG. 3, the entry surface 40 is formed with the use of a frustoconical machining electrode, generally designated by the numeral 90, which includes a central axis Y coaxial with the central axis X of the bore 16. The electrode 90 includes frustoconical surfaces 92 and 94 for forming the first portion 44 and the second portion 46, respectively, of the entry surface 40. It is understood that, due to the frustoconical shape of the surfaces 92 and 94, the first and second portions 44 and 46 of the entry surface 40 are not only inclined with respect to the central axis X but, also, are frustoconical in shape.

The entry surface 40 may be formed through a known electrical discharge machining process wherein the side surfaces 22 of the drive bore 16 are eroded away as the electrode is inserted into the drive bore 16, thereby forming the first and second portions 44 and 46. It will be understood that the entry surface 40 could also be formed with the use of other known processes.

Figure 5:
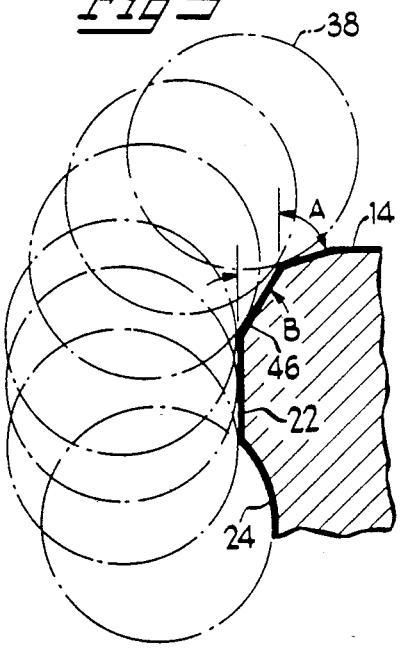
PRIOR ART Fig 5
FIG. 5 is a view, similar to FIG. 2 of the entry surface of the drive element of FIG. 1 and illustrating the ball of the drive lug in the various positions it will take as the drive lug is inserted in or withdrawn from the drive bore.

FIG. 5 depicts the entry surface 40 of the drive element 10 of the present invention wherein the first portion 44 is inclined at a first slope or angle A with respect to the central axis of the drive bore 16 and the second portion 46 is inclined at a second slope or angle B with respect to the central axis of the drive bore 16 which is substantially less than the angle A. In the embodiment of FIG. 5, angle A may be approximately 75 degrees while angle B may be approximately 30 degrees.

It has been found that the compound entry surface 40 provides an improved conversion of axial push-on force to lateral ball-depressing force. The result is a smaller total push-on force than in prior art tools with a single entry surface at angle A, and a smaller depth of extension of the entry surface 40 into the drive bore 16 than in prior art tools with a single entry surface at angle B.

Figure 6:
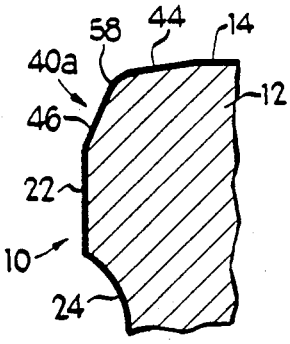
FIG. 6 a view, similar to FIG. 2, of another embodiment of the drive element of the present invention.
Figure 7:
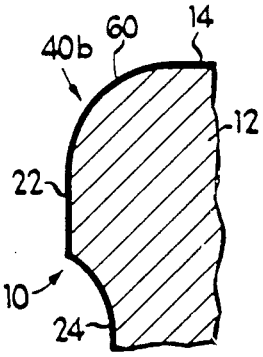
FIG. 7 is a view, similar to FIG. 2, of yet another embodiment of the drive element of the present invention.

Alternatively, the entry surface 40 may be constructed as depicted in either of FIGS. 6 and 7.

As shown in FIG. 6, the drive element may comprise an entry surface **40*a* wherein the first portion 44 and the second portion 46 are interconnected by a continuously sloping curved portion 58 which serves to provide a smooth transition for the ball 38 as it rolls from the first portion 44 to the second portion 46. The entry surface 40*a* provides all of the advantages of the entry surface 40 shown in FIG. 5**.

As shown in FIG. 7, the drive element may, alternatively, comprise an entry surface **40*b* including a continuously sloping curved surface 60 which extends from the outer surface 14 of the body 12 partially into the drive bore 16 to a point on the side surface 22 of the body 16 short of the recess 24. The entry surface 40*b*, like the entry surface 40, increases the portion of the side surfaces 22 available for driving engagement with the drive lug while at the same time providing for the application of a large lateral component of force against the ball to facilitate the retraction thereof and thereby minimizing the push-on force required to mount the drive element 10 on the drive lug 70**.

From the foregoing, it can be seen that there has been provided a drive element comprising an entry surface which significantly enhances the retraction of a ball attached to the side surface of a drive lug to be inserted into the drive bore without unduly decreasing the portion of the side surface of the drive bore which is available for driving engagement with the drive lug.

We claim:

1. A drive element for use with a driver comprising: a body including an outer surface, a drive bore formed in said body including an entry end at said outer surface and an inner end, said drive bore including a central axis and a plurality of intersecting flat side surfaces parallel to said axis, and a sloping entry surface formed at the entry end of said drive bore around the perimeter thereof, said entry surface extending from said outer surface partially into said drive bore and including multiple discrete portions with each portion being a surface such that the intersection of said entry surface with a plane including said central axis defines a plurality of generally straight lines respectively having different slopes.

2. The element of claim 1, wherein said sloping entry surface includes a first portion extending inwardly from said entry end, and a second portion extending inwardly from said first portion, said first portion having a first slope and said second portion having a second slope.

3. The element of claim 2, wherein said first and second portions are interconnected by a portion having a continuously varying slope.

4. The element of claim 1, wherein at least a portion of said sloping entry surface has a continuously varying slope.

5. The element of claim 1, wherein said drive bore has four flat side surfaces.

6. The element of claim 5, wherein said drive bore is substantially square in transverse cross-section.

7. The element of claim 1, wherein at least a portion of the sloping entry surface is frustoconical in shape.

8. The element of claim 1, wherein each portion of the sloping entry surface is frustoconical in shape.

9. The element of claim 1, wherein said sloping entry surface is annular in shape.

10. The element of claim 2, wherein said second slope is steeper than said first slope.

11. In combination: a driver comprising a drive lug including a plurality of intersecting flat side surfaces, a retractable ball projecting from one of the side surfaces, and means for resiliently urging said ball to its projecting position; and a drive element comprising a body including an outer surface and a drive bore formed in said body including an entry end at said outer surface and an inner end, said drive bore having a central axis and a plurality of intersecting flat side surfaces parallel to said axis and corresponding in number to said plurality of side surfaces on said drive lug for mateably receiving said drive lug, at least one of said side surfaces of said drive bore having a recess therein intermediate the entry and inner ends thereof, and a sloping entry surface formed at the entry end of said drive bore around the perimeter thereof, said entry surface extending from said outer surface partially into said drive bore and including multiple discrete portions with each portion being a surface such that the intersection of said entry surface with a plane including said central axis defines a plurality of generally straight lines respectively having different slopes to facilitate the retraction of said ball when said ball contacts said sloping entry surface upon the insertion of said drive element onto said drive lug, said drive element being secured on said drive lug when said ball on said driver is seated within said recess in one of said side surfaces of said drive bore.

12. The combination of claim 11, wherein said sloping entry surface includes a first portion extending inwardly from said entry end, and a second portion extending inwardly from said first portion, said first portion having a first slope and said second portion having a second slope.

13. The combination of claim 12, wherein said first and second portions are interconnected by a portion having a continuously varying slope.

14. The combination of claim 11, wherein at least a portion of said sloping entry surface has a continuously varying slope.

15. The combination of claim 11, wherein said drive lug has four flat side surfaces.

16. The combination of claim 15, wherein said drive bore is substantially square in transverse cross-section.

17. The combination of claim 11, wherein at least a portion of the entry surface is frustoconical in shape.

18. The combination of claim 11, wherein each portion of the entry surface is frustoconical in shape.

19. The combination of claim 11, wherein said sloping entry surface is annular in shape.

20. The combination of claim 12, wherein said second slope is steeper than said first slope.

* * * * *